United States Patent [19]

Jahn

[11] 4,024,812

[45] May 24, 1977

[54] REMOVABLE NUMBERING AND IMPRINTING DEVICE FOR SHEET-FED OFFSET MACHINES

[75] Inventor: Hans-Georg Jahn, Wiesloch, Germany

[73] Assignee: Heidelberger Druckmaschinen Aktiengesellschaft, Heidelberg, Germany

[22] Filed: Sept. 30, 1975

[21] Appl. No.: 618,220

Related U.S. Application Data

[63] Continuation of Ser. No. 355,739, April 30, 1973, abandoned.

[30] Foreign Application Priority Data

May 2, 1972 Germany ..... 2221343

[52] U.S. Cl. ..... 101/76; 101/349

[51] Int. Cl.[2] ..... B41L 49/02

[58] Field of Search ..... 101/76, 77, 91, 92, 101/144, 216, 349, 350, 375

[56] References Cited

UNITED STATES PATENTS

| | | | |
|---|---|---|---|
| 2,109,486 | 3/1938 | Jirousek | 101/144 |
| 2,358,284 | 9/1944 | Davidson et al. | 101/144 |
| 2,398,832 | 4/1946 | Jirousek | 101/77 |
| 2,670,679 | 3/1954 | Stephenson | 101/216 |
| 2,730,946 | 1/1956 | Dubois et al. | 101/216 |
| 3,276,362 | 10/1966 | Grunig | 101/216 |
| 3,598,050 | 8/1971 | Thompson | 101/216 |
| 3,611,921 | 10/1971 | Jahn | 101/77 |
| 3,728,960 | 4/1973 | Heath | 101/76 |

*Primary Examiner*—Edgar S. Burr
*Assistant Examiner*—Paul J. Hirsch
*Attorney, Agent, or Firm*—Herbert L. Lerner

[57] ABSTRACT

A removable numbering and imprinting device cooperable with a printing cylinder of a sheet-fed offset machine and located between the rubber cylinder and the sheet delivery includes a numbering shaft mounted on the machine frame and detachably carrying a plurality of numeral units. A self-contained structure defining an inking mechanism is mounted on the machine frame and operable to ink the numeral units. The inking mechanism is readily removable from the machine frame separately from the numbering shaft and the numeral units, whereby removal of the inking mechanism from the machine frame provides ready access to the numbering shaft and the numeral means.

6 Claims, 5 Drawing Figures

Fig. 2
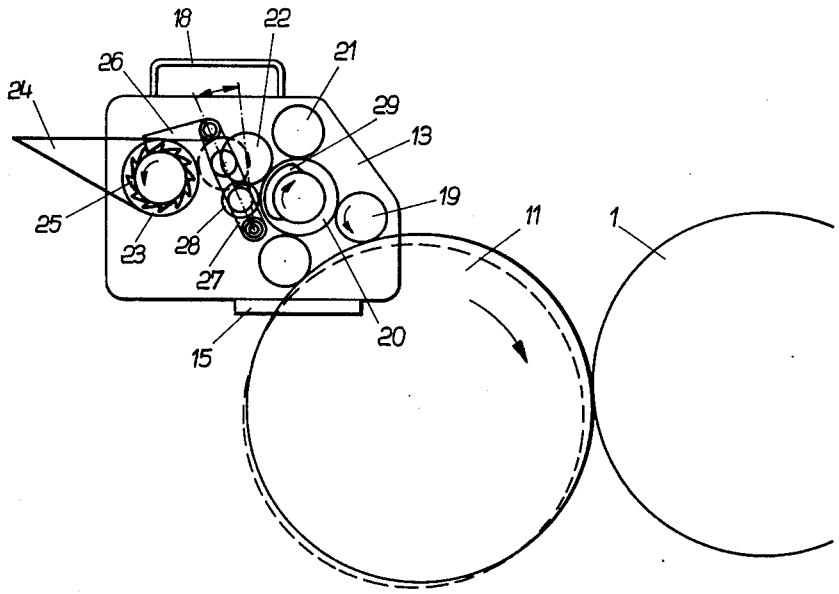
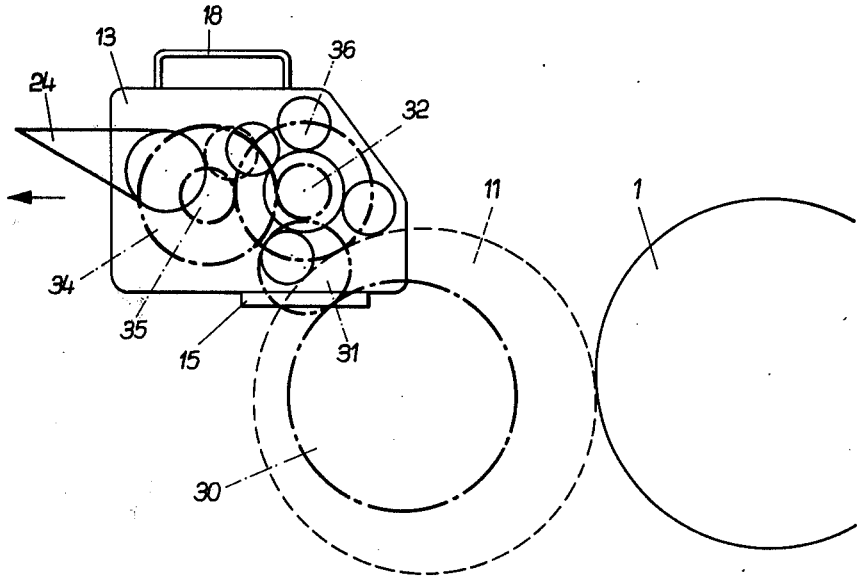
Fig. 4

Fig. 3
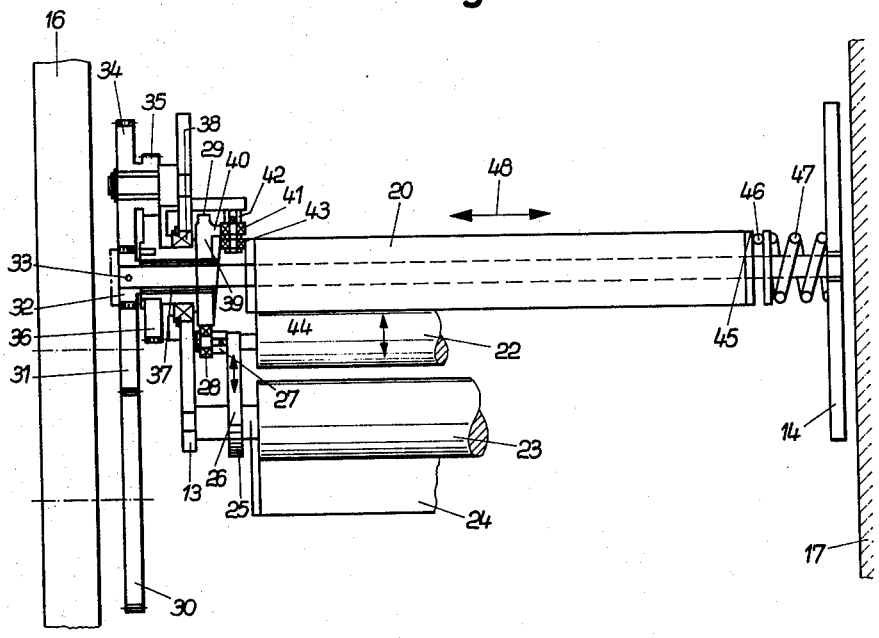
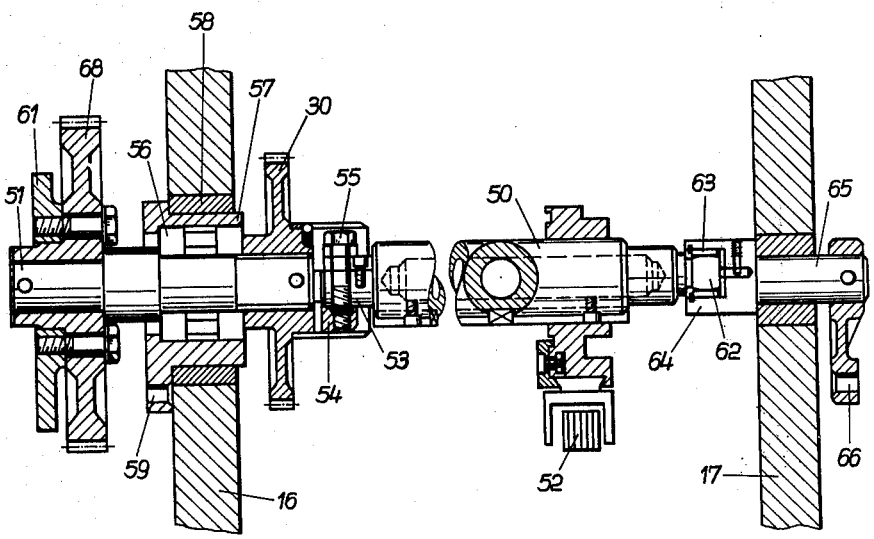
Fig. 5

REMOVABLE NUMBERING AND IMPRINTING DEVICE FOR SHEET-FED OFFSET MACHINES

This is a continuation of application Ser. No. 355,739, filed Apr. 30, 1973, now abandoned.

This invention relates to a removable numbering and imprinting device for sheet-fed offset machines in which the removable numbering and imprinting device cooperates with the printing or impression cylinder and is located in the empty space between the rubber cylinder and the sheet delivery.

An object of the invention is to provide for ease of removal of a numbering and imprinting mechanism.

A sheet-fed offset machine for small sheet sizes is known in which a numbering or imprinting mechanism can be run or moved toward the machine and inserted and locked therein. However, a disadvantage of the known arrangement is that the entire numbering and imprinting mechanism is designed as a block which is removable as a unit. Accordingly, a special carriage is required for removing the numbering and printing mechanism unit.

It is an object of the invention to provide a numbering and imprinting mechanism in such a manner that support devices such as a carriage, for example, become unnecessary for effecting removal of the numbering and imprinting mechanism from the machine.

According to the present invention, the aforementioned object is achieved by providing that a numbering shaft carrying several numeral units is detachably connected with bearing and drive members which are arranged in stationary relation to the machine frame, and that an inking mechanism which links the numeral units or imprint cuts is designed as a structural unit which can be removed from the numbering and imprinting device.

By removing the inking mechanism according to the invention, the numbering shaft with the numeral units becomes highly assessible. The individual subassemblies, that is, the inking mechanism and the numbering shaft with the numeral units, can be placed in or removed from the machine without any special support device.

In order to save or conserve space as well as to simplify the drive and the coupling of the inking mechanism drive, all control operations of the moving parts of the inking mechanism are derived, in a preferred embodiment of the invention, from a gear attached at bearing members of the numbering shaft.

Other features which are considered as charcteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings, in which:

FIG. 2 is a schematic elevational view showing the rollers of the removable inking mechanism;

FIG. 3 is a top view of the inking mechanism shown in FIG. 2;

FIG. 4 is a schematic elevational view showing the gearing of the removable inking mechanism; and FIG. 5 is a sectional view of the removable numbering shaft according to the invention.

Figure 1:
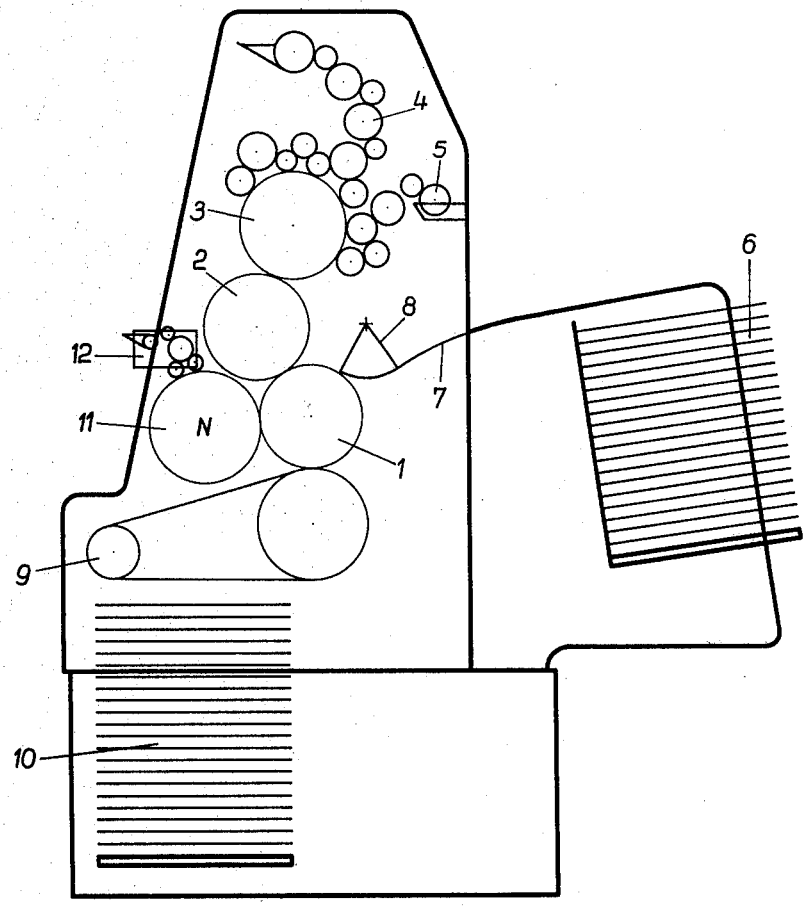
FIG. 1 is a schematic elevational view of a sheet-fed offset machine having a numbering and imprinting device according to one embodiment of the invention.

Referring to the drawings, FIG. 1 shows generally the overall arrangement of a sheet-fed offset machine for handling smaller sheet sizes. As usual, the machine consists of a printing or impression cylinder 1, a rubber cylinder 2, a plate cylinder 3, an inking mechanism 4, and a moistening mechanism 5. A sheet is fed to the printing cylinder 1 from a feed pile 6 via a feed table 7 by means of a swinging gripper 8.

The printing cylinder 1 delivers the printed sheet to a sheet delivery 9 which passes it on to a delivery boy 10. Between the rubber cylinder 2 and the sheet delivery 9 there is provided a numbering and imprinting device 11. The imprinting device 11 cooperates with the printing cylinder 1 and has an inking mechanism 12 which is constructed and arranged so that it can be removed by itself.

The removable inking mechanism 12 which is shown in a side elevation in FIG. 2, is designed as a self-contained structural unit. As can be seen in FIG. 3, the removable inking mechanism 12 has side walls 13 and 14 which have guide rails 15 at their bottom sides. These guide rails 15 can be inserted into corresponding guideways (not shown) in walls 16 and 17 of the machine frame. At the tops of the side walls 13 and 14 of the removable inking mechanism 12 there are provided handles 18 which facilitate the removal and reinsertion of the inking mechanism 12.

The inking mechanism according to the present invention is provided with two inking rollers 19 which cooperate with a traversing ink cylinder 20 in which a distributor roller 21 also runs. An ink vibrator 22 is alternatingly placed against a ductor roller 23 and the traversing ink cylinder 20. The ductor roller 23 is located, as usual, in an ink well 24 and is driven by a rachet wheel 25 which is advanced tooth by tooth by a pawl 26. The pawl 26 is pivoted at the free end of a fulcrumed lever 27 which is fulcrumed in the side wall 13. The fulcrumed lever 27 also supports the ink vibrator 22. Below the point of contact of the ink vibrator 22, a roll 28 is provided on the fulcrumed lever 27 and this roll 28 runs on a control cam 29 as will be further described.

The arrangement of the drive gears is shown in detail in FIGS. 3 and 4. A drive gear 30, which is mounted securely on a bearing shaft 51 of a numbering shaft 50, is in continuous engagement with an intermediate pinion 31 which drives a pinion 32 which is attached on the shaft 33 of the traversing ink cylinder 20. A dual gear 34, supported in the inking mechanism side wall 13, is driven by the pinion 32 and drives with its second gear rim 35, a gear 36 which is attached to a hollow shaft 37. The hollow shaft 37 is rotatably supported in the side wall 13 of the removable inking mechanism by means of a bearing 38. At the end of the hollow shaft 37 opposite the gear 36, there is provided a cam disc 39 at which the previously mentioned switch cam 29 is situated.

The cam disc 39 is further provided with another control curve or surface 40 which extends in an axial direction and against which a roll 41 rests. The roll 44 is supported on a pivoted lever 42. On the shaft of the roll 41 is situated a further roll 43 which rests against the end face 44 of the traversing ink cylinder 20.

At the opposite end face 45 of the traversing ink cylinder 20 an axial bearing 46 is provided against which a compression spring 47 is biased. The compression spring 47 bears with its other end against the side wall 14 of the removable inking mechanism 12.

When the inking mechanism 12 is being pushed in or inserted in the machine, that is, when the guide rails 15 are inserted into the guideways (not shown), the intermediate pinion 31 comes into engagement with the pinion 32. Thereby, the ink cylinder 20 is set in rotation and the control cam 39 is driven via the gears 34, 35 and 36. An oscillating motion is thereby imparted to the roller 28 and the lever 27 by means of the control cam 29. The oscillating motion is used, on the one hand, for swinging the ink vibrator 22 back and forth and, on the other hand, to drive the inking ductor 23. The rotation of the control arm 29 also causes the lever 42 to swing via the axially extending control cam 40 and the roll 41, so that the ink cylinder 20 is moved axially back and forth on the shaft 33 in the direction of the arrow 48 via the further roll 43.

Because the drive for all the parts of the inking mechanism 12 to be moved is derived from a single drive gear 30, the design of the inking mechanism 12 according to the invention is extremely simple and the coupling of the insertable inking mechanism 12 with the elements to be driven can be accomplished without difficulty.

FIG. 5 shows the arrangement of the numbering shaft 50 which is provided with several numeral units 52. At one end the numbering shaft 50 has a journal 53 provided with a flat which is disposed in a bearing sleeve shell 54 and is firmly connected with the latter by means of a hexagonal-head screw 55. The bearing sleeve shell 54 is part of the hub of the drive gear 30 which, as already mentioned above, is firmly attached on the bearing shaft 51. This bearing shaft 51 is supported via ball bearings 56 in an eccentric release bushing 57 which is rotatably supported in the wall 16 of the machine frame by means of a bushing 58. The flange of the release bushing 57 has a release lever 59 which is hinged to a tie rod (not shown).

The free end of the bearing shaft 51 carries a drive spur gear 68 and a cam 61. The drive spur gear 68 is in engagement with a gear (not shown) of the printing cylinder shaft. The cam 61 serves to advance the numeral units 52. The further switching means provided for this purpose are not shown for the sake of clarity.

At its other end, the numbering shaft 50 has a crowned journal 62 which is inserted into a needle bearing 63 which is mounted in a bearing sleeve 64. At this bearing sleeve 64 there is provided an eccentric journal 65 which is rotatably arranged in a bearing supported by the wall 17 of the machine frame. At the free end of the journal 65 is attached a release lever 66 which is used, just as the release lever 59, for disengaging the numeral unit from the printing cylinder 1 and the inking rollers 19.

After removing the inking mechanism 12 of the numbering and imprinting device 11 in the manner described above, the printing machine operator has access without much effort to the numeral units 52 and the numbering shaft 50. The location of the inking mechanism 12 and the inking roller 19, respectively, however, makes it also possible for the printing machine operator to make numeral corrections without dismantling the inking mechanism 12. It is further possible to take out the numbering shaft 50 carrying the numeral units 52 at any time without dismantling the inking mechanism 12. Similarly, the inking mechanism 12 can be taken out without affecting the numbering shaft.

The removal of the numbering shaft 50 can be carried out very rapidly. Thus, only the hexagonal-head screw 55 needs to be loosened and then the printer can lift the journal 53 with the flat from the bearing sleeve shell 54 and pull the crowned journal 62 out of the needle bearing 63 of the bearing bushing 64. Insertion of the numbering shaft takes place in the reverse sequential order. Thus, the printer first inserts the crowned journal 62 into the needle bearing 63 and then lowers the journal 53 with the flat into the bearing sleeve shell 54. Then, the numbering shaft 50 is again firmly connected with shaft 1 by inserting the hex-head screw 55.

Due to the fact that, on the one hand, the inking mechanism 12 of the numbering and imprinting device can be removed and, on the other hand, it is possible to remove only the numbering shaft 50 with the numeral units 52 from the bearing parts remaining in the walls 16 and 17 of the machine frame, the printing machine operator needs no additional aids or support means to remove these subassemblies of the numbering and imprinting device 11 from the sheet-fed offset machine or to reinsert them.

I claim:

1. In a sheet-fed offset machine, having a machine frame, cooperating printing, rubber and plate cylinders, an inking mechanism for the plate cylinder and a sheet delivery spaced from the rubber cylinder, a numbering and imprinting device removably mounted in the space between the rubber cylinder and the sheet delivery and cooperating with the printing cylinder, the removable numbering and imprinting device comprising an intermediate shaft portion carrying a plurality of numeral units, means for removably mounting said intermediate shaft portion on a numbering shaft, carried by the machine frame, means detachably mounting said numeral units on said intermediate shaft portion, and an inking mechanism mounted on said machine frame and operable to ink said numeral units, said inking mechanism being a self-contained, structural unit readily removable from said frame separately from said numbering shaft and said numeral units, whereby removal of said inking mechanism from said machine frame provides ready access to said numbering shaft and said numeral means.

2. A removable numbering and imprinting device according to claim 1 including a gear mounted on said numbering shaft, and means providing an operable engagement between said gear and said inking mechanism whereby said gear controls the operation of all of the moving parts of said inking mechanism.

3. A removable numbering and imprinting device according to claim 2 wherein said inking mechanism includes a gear, said latter gear being connected to said gear on said numbering shaft by an intermediate gear upon insertion of said inking mechanism into said machine frame, said inking mechanism gear being disconnected from said numbering shaft gear upon removal of said inking mechanism from said machine frame.

4. A removable numbering and imprinting device according to claim 1 wherein said means detachably connecting said intermediate shaft portion to the remainder of said numbering shaft includes bearing means between one end of said intermediate shaft portion and one section of the remainder of said numbering shaft and a bearing sleeve shell and fastening device between the other end of said intermediate shaft portion and another section of the remainder of said numbering shaft.

5. A removable numbering and imprinting device according to claim 2 wherein said gear has a hub, said hub forming at least partially a bearing sleeve by which portions of the numbering shaft are detachably connected to one another.

6. A removable numbering and imprinting device according to claim 4 including a gear mounted on said numbering shaft and operating said inking mechanism, said gear having a hub, said bearing sleeve shell being formed in said hub.

* * * * *